US007191922B1

(12) United States Patent
Sutton et al.

(10) Patent No.: US 7,191,922 B1
(45) Date of Patent: Mar. 20, 2007

(54) HANGER WITH NON-SLIP PADS

(75) Inventors: Steven Sutton, Deal, NJ (US); David P. Gordon, Stamford, CT (US)

(73) Assignee: The Accessory Corp., New York, NY (US)

( * ) Notice: Subject to any disclaimer, the term of this patent is extended or adjusted under 35 U.S.C. 154(b) by 334 days.

(21) Appl. No.: 10/925,668

(22) Filed: Aug. 25, 2004

(51) Int. Cl.
*A41D 27/22* (2006.01)

(52) U.S. Cl. ..... 223/91

(58) Field of Classification Search ..... 223/85–98
See application file for complete search history.

(56) References Cited

U.S. PATENT DOCUMENTS

| | | | | |
|---|---|---|---|---|
| 5,890,634 | A | 4/1999 | Zuckerman et al. | 223/96 |
| 6,199,728 | B1 | 3/2001 | Cohen | 223/96 |
| 6,306,329 | B1 | 10/2001 | Willinger | 264/255 |
| 6,612,000 | B2 | 9/2003 | Housley | 24/510 |
| 2004/0065702 | A1* | 4/2004 | Yang | 223/96 |
| 2006/0163294 | A1* | 7/2006 | Sutton et al. | 223/85 |

* cited by examiner

*Primary Examiner*—Shaun R. Hurley
(74) *Attorney, Agent, or Firm*—Gordon & Jacobson, PC

(57) ABSTRACT

A hanger has a body, a hook extending therefrom, and at least one clamp coupled thereto. The clamp includes a pair of opposing jaw members that are provided with slots extending through peripheral walls of the jaw member, and a gripping pad having T-shaped lateral extensions, the necks of which are extended through the slots, and the heads of which hold against the back surface of the jaw member to prevent the gripping pad from falling off the jaw member. The back surface of the clamping member includes wall areas defining wells in which the heads of the T-shaped lateral extensions are captured and substantially surrounded. By sizing the wells properly, the T-shaped extensions are easily slipped through the slots and into the wells, but it becomes difficult to remove the gripping pad from the jaw via a finger purchase.

24 Claims, 7 Drawing Sheets

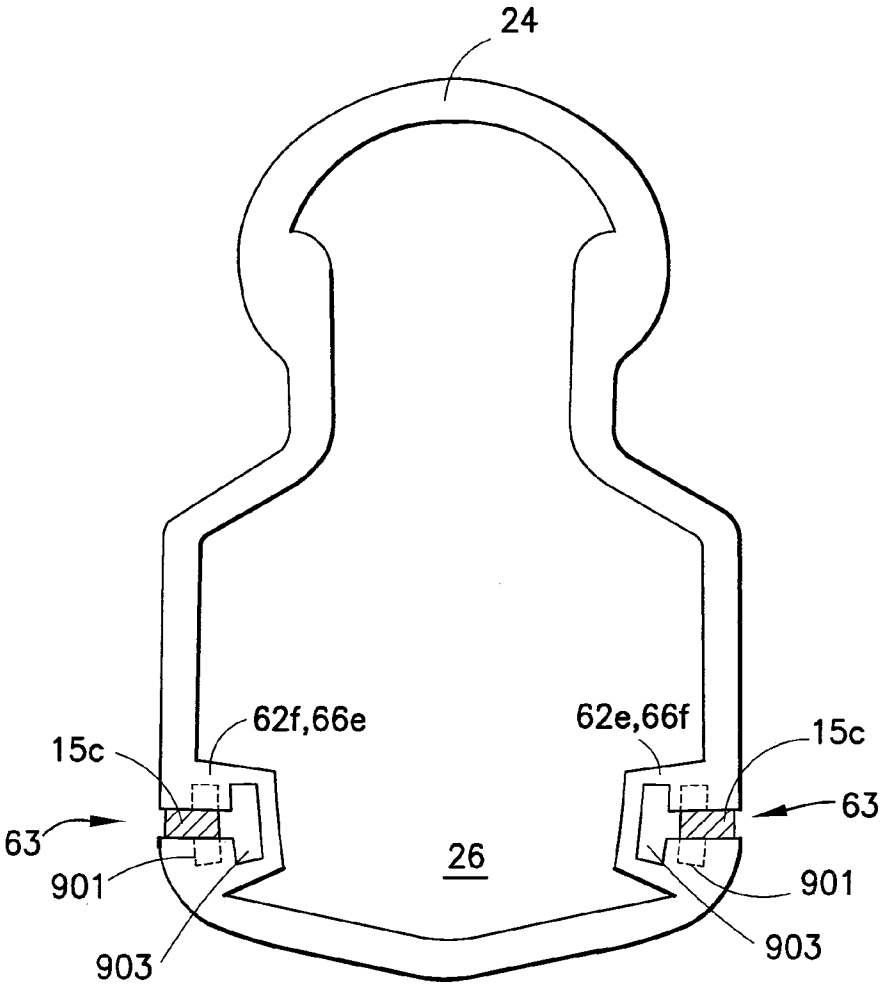
FIG.9
FIG.8A
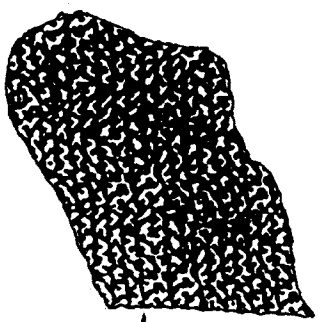
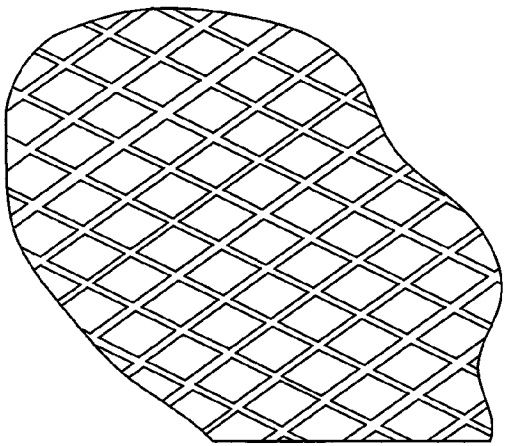
FIG.8B

HANGER WITH NON-SLIP PADS

BACKGROUND OF THE INVENTION

1. Field of the Invention

This invention relates broadly to clamp-type garment hangers having non-slip surfaces for gripping garments. More particularly, this invention relates to a clamp-type garment hanger having exposed gripping pad elements which are difficult to remove from the hanger.

2. State of the Art

A common problem associated with today's clamp-type garment hangers is that the garments slip through the clamp assemblies (clamps) and fall to the floor with unacceptable frequency. This problem is particularly annoying to garment suppliers, retailers, or others in the retail supply chain. In this supply chain, garments are placed on hangers at a place of manufacture (typically abroad) and then shipped on the hanger to a port of destination (often in the United States). From the port, the hung garments are distributed to stores throughout the U.S. for storage and display. Garments which slip through the clamps during transit, or even after display, often become wrinkled or soiled and represent a loss to the entity. This problem is likewise annoying to consumers who may place a relatively expensive and fragile garment, such as a pair of dress slacks or a skirt, on a clamp-style garment hanger. The slacks or skirt often slip through the clamp assemblies and fall to the floor, thereby becoming wrinkled and requiring ironing or dry cleaning.

In order to avoid this situation, manufacturers of clamp-style garment hangers have designed numerous types of clamp assemblies which provide a non-slip surface for gripping the garment. Some of those clamp assemblies have rough or sharp edges which grip the garment. However, clamp assemblies with rough garment-engaging surfaces have the potential of damaging delicate materials, such as silk or linen, through extended use.

In other prior art clamp type gripping hangers, the gripping or non-slip material is either glue bonded to the clamping member of the garment hanger or co-molded therewith. Hangers of this design have not been found to be particularly satisfactory for several reasons. From the point of view of the manufacturer, the operations of co-molding or gluing are expensive and slow and therefore have a deleterious effect on both the hanger production throughput and the hanger production cost. In addition, if a manufacturer is providing the retailer-purchaser with a hanger which cannot be easily disassembled and then re-assembled to change the gripping material or the thickness or size of the gripping pad, the versatility of the garment hanger is lost. During the life of a given garment hanger, it may be desirable at various times for the hanger to suspend various different fabrics, each calling for particular gripping pads adapted for that fabric. Co-molded or glued gripping pads are not easily replaceable by the retail customer.

Another clamp assembly, such as shown and described in U.S. Pat. No. 6,199,728 provides non-slip gripping surfaces which are integrally formed with the clamp jaws by injection molding with substantially identical materials where the gripping surfaces have relatively blunt relief structures which provide an increased coefficient of friction to the gripping surfaces. While hangers using this arrangement have been extremely successful commercially as they effectively prevent garment slippage without damaging the garment, it is desirable that the gripping surface be made from a softer material or different material than the remainder of the hanger in some circumstances, such as a material that provides a greater coefficient of friction for supporting heavier garments.

In U.S. Pat. No. 5,890,634, a hanger having a clamp assembly with a snap-on non-slip pad made of different material than the hanger is disclosed. The hanger has clamping members of one material which are provided with slots extending through the middle of the clamping members, and a gripping pad of another material which has extending from its back surface two resilient arrow-shaped lugs which are adapted to be snapped into the slots. According to the patent, the gripping pad is made from a resilient friction material such as polyvinyl chloride or polypropylene.

While the snap-on non-slip pad arrangement disclosed by the '634 patent has certain advantages, it suffers from apparent disadvantages. More particularly, resistance to child tampering is often required by standards, such as certain VICS standards, commonly used in the retail industry. In order to comply with such standards and provide the necessary child proof features, the lugs of the snap-on pad are generally harder than the slots into which they are snapped. This effectively limits the pads to relatively hard materials which, if textured to provide an increased coefficient of friction, can damage delicate materials; and if not textured, do not provide desirable gripping characteristics.

An improvement to the solution suggested by the '634 patent is a hanger manufactured by Acotex Fast East Ltd. Of Hong Kong which provides clamping members having slots extending through the peripheral walls of the clamping members and a soft elastic gripping pad having T-shaped lateral extensions, the necks of which can be extended through the slots, and the heads of which hold against the back surface of the clamping members to prevent the gripping pad from falling off the clamping member. The elastic gripping pad is preferably provided with surface nubs to increase friction on the garment it is holding.

While the Acotex hanger provides certain desirable qualities, it suffers from the drawback that the gripping pad is easily removed by finger manipulation, particularly by children (e.g., by pulling on the head of the gripping pad and stretching the neck such that the head is released from its position against the back surface of the clamping member). Thus, the Acotex gripping pad is potentially unsafe and can represent a choking hazard to small children. In this regards, it does not comply with the industry standards that require child tamper-proof designs.

SUMMARY OF THE INVENTION

It is therefore an object of the invention to provide a clamp-type garment hanger with gripping pads which are added to the hanger after molding but which are resistant to removal.

It is another object of the invention to provide a garment hanger with gripping pads which are easily mechanically secured to the hanger but are relatively difficult to remove from the hanger by a child.

It is another object of the invention to provide a garment hanger with textured gripping pads which grip delicate fabrics without leaving marks and which are mechanically secured to the hanger.

In accord with the objects of the invention, a hanger is provided having a body, a hook extending from the cross-bar member, and at least one clamp coupled to the cross-bar member. The clamp includes a pair of opposing clamping or jaw members that are urged towards one another in order to sufficiently to secure a garment. At least one, and preferably both of the jaw members are provided with slots extending through peripheral walls of the jaw member, and a gripping pad having T-shaped lateral extensions, the necks of which are extended through the slots, and the heads of which hold against the back surface of the jaw member to prevent the gripping pad from falling off the jaw member. The back surface of the clamping member includes wall areas which define wells or recesses in which the heads of the T-shaped lateral extensions are captured and substantially surrounded and/or covered. The conforming size and shape of the heads and wells makes it difficult to remove the gripping pad from the jaw via a finger purchase.

According to one embodiment of the invention, the lateral extensions and gripping surface (and possibly the entire gripping pad) is realized from a soft elastomeric thermoplastic.

Additional objects and advantages of the invention will become apparent to those skilled in the art upon reference to the detailed description taken in conjunction with the provided figures.

BRIEF DESCRIPTION OF THE DRAWINGS

FIG. 8A is a partial view of a textured gripping surface structure of an exemplary garment hanging device according to the present invention.

FIG. 8B is a partial view of a patterned gripping surface structure of an exemplary garment hanging device according to the present invention.

FIG. 9 is a plan view of the exterior side of a jaw member in accordance with an alternate embodiment of the present invention.

DETAILED DESCRIPTION OF THE PREFERRED EMBODIMENTS

Figure 1:
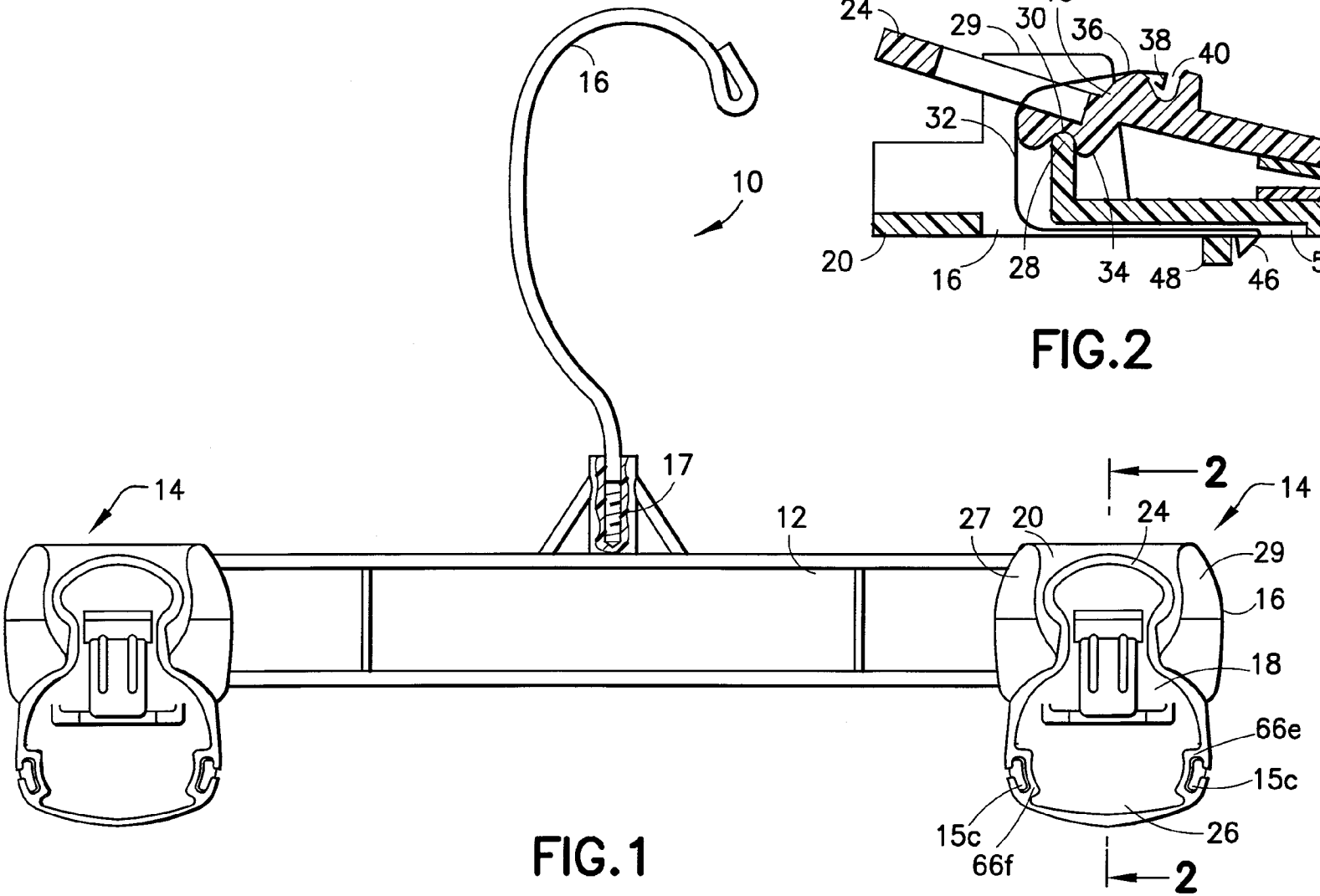
FIG. 1 is a front view of a hanger of the invention.
Figure 3A:
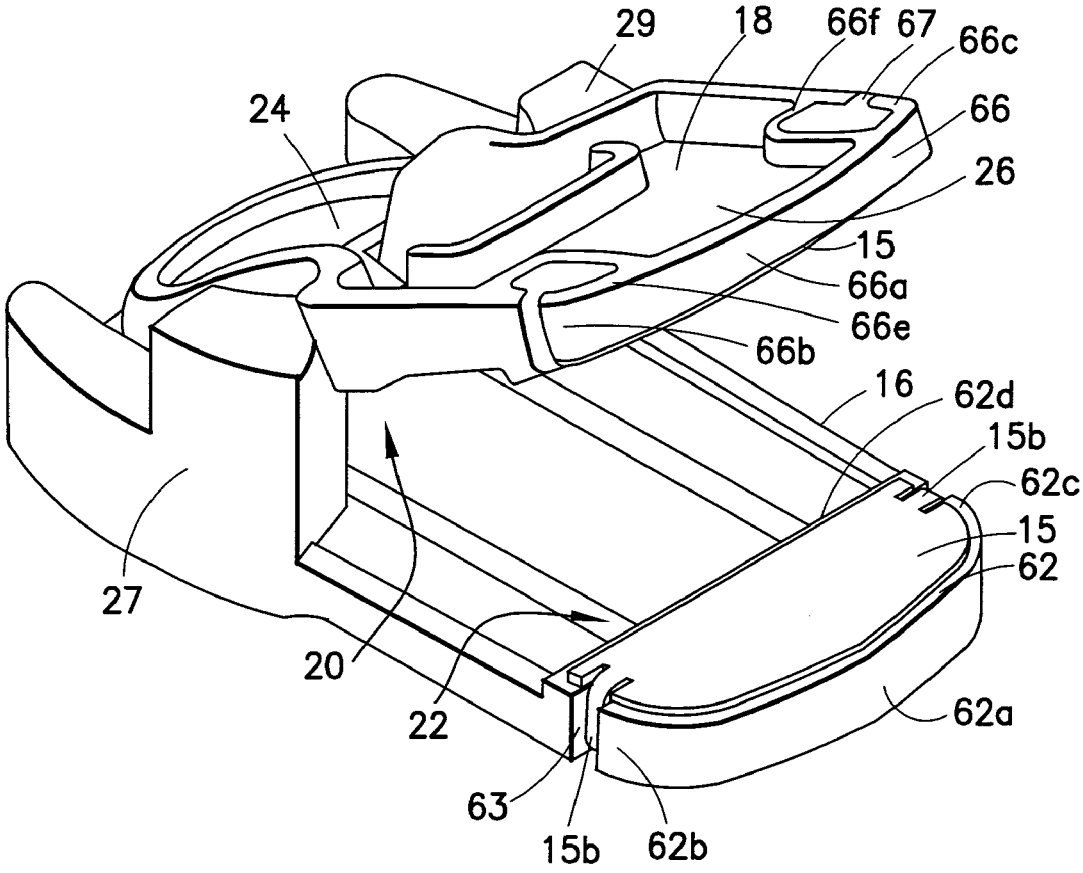
FIG. 3*a* is a perspective view of the jaws of FIG. 1 in an open position.
Figure 3B:
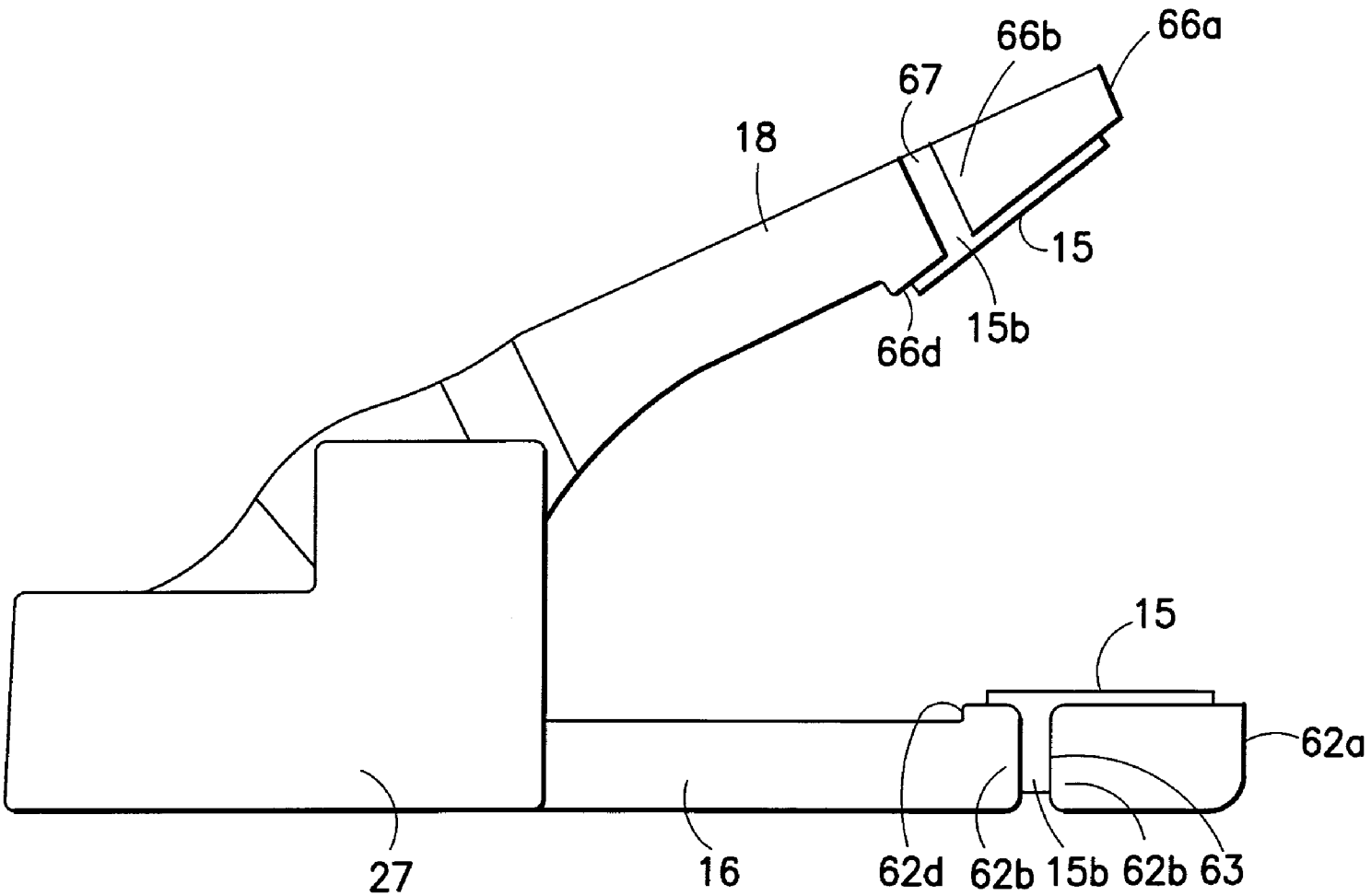
FIG. 3*b* is a side view of the jaws of FIG. 1 in an open position.
Figure 4:
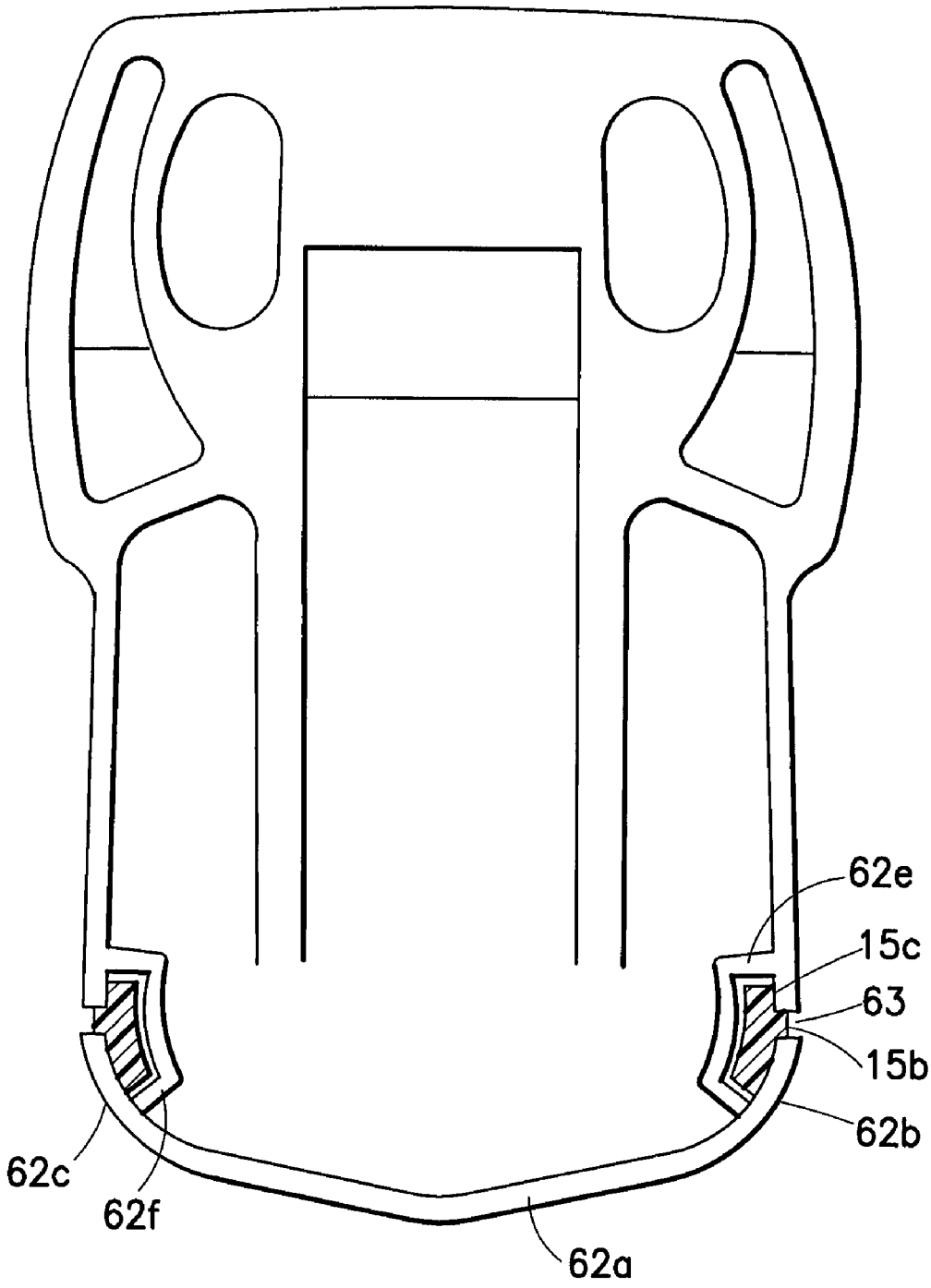
FIG. 4 is a plan view of the bottom side of the bottom jaw of FIG. 1.
Figure 5:
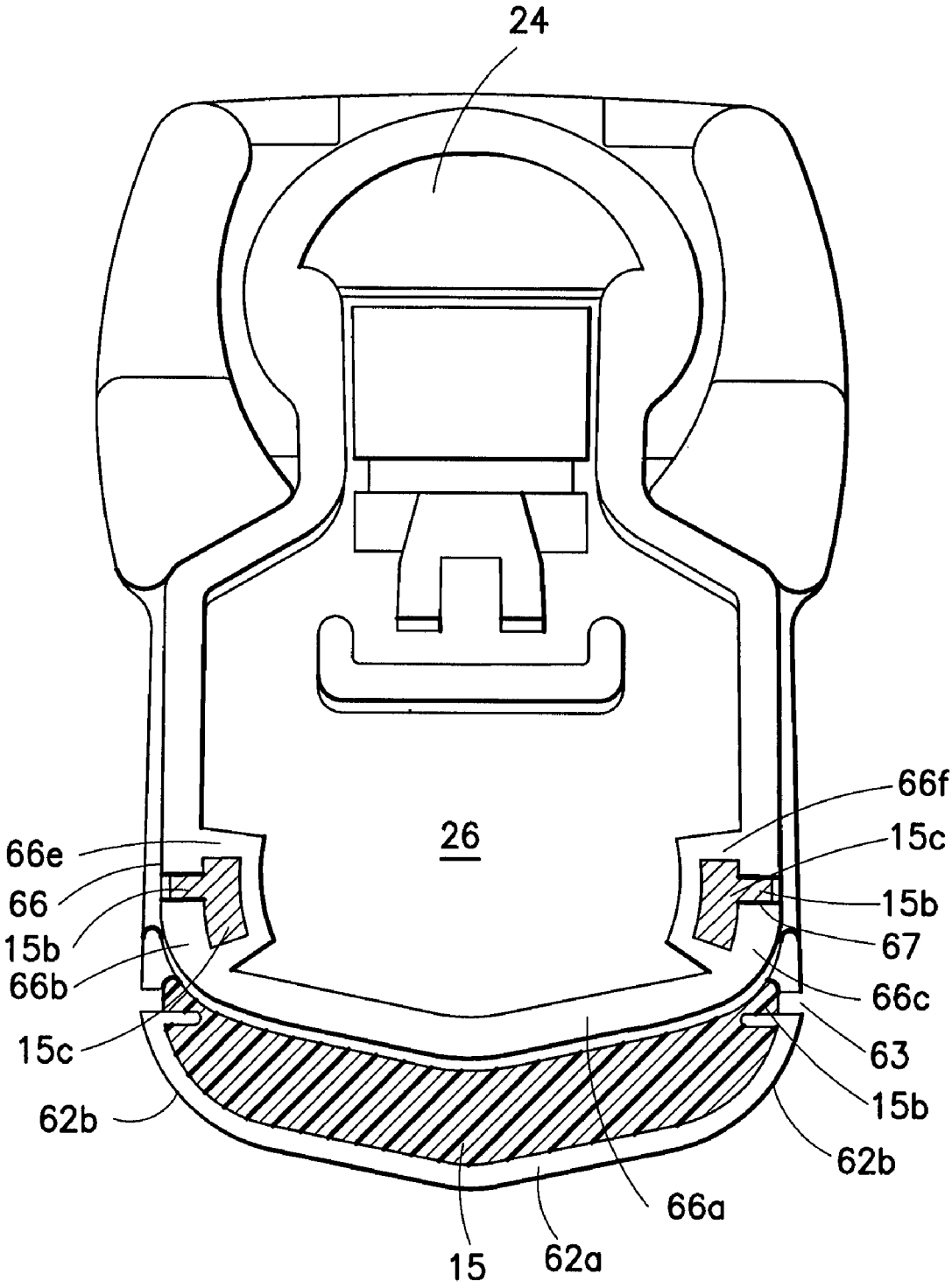
FIG. 5 is a top perspective view of the jaws in an open position.

Referring now to FIG. 1, a garment hanger 10 includes a hanger body 12 having at each end a pinch-type clamp 14 having a gripping pad 15. Garment hanger 10 includes a partial loop or hook member 16, which may be formed from plastic or metal wire or any other appropriate material. The partial loop or hook member may be formed separately from the body 12 and secured thereto via threads 17, as shown, or may be integrally formed from the same material as body 12, or may be connected to the body in any other manner. The body 12 is preferably made from any number of well known plastics or resin materials, such as "k"-resin, polystyrene, polypropylene, polyethylene, styrene-butadiene copolymers and blends, polycarbonates, and combinations thereof.

Figure 2:
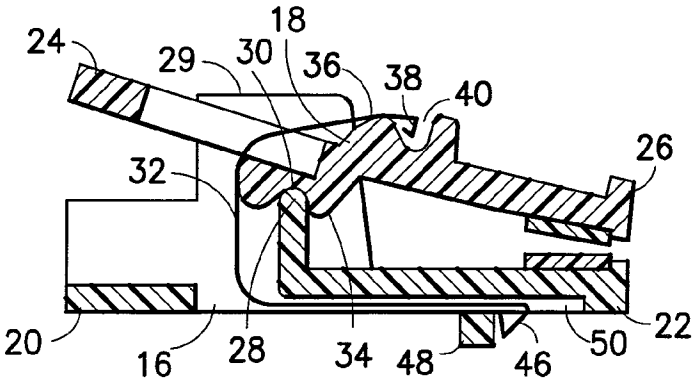
FIG. 2 is a sectional view taken along line 2—2 of FIG. 1.

Referring now to FIGS. 1 and 2, the clamps 14 are preferably formed from the same material as the body 12, while the gripping pads 15 are made from a different material. Preferably, the gripping surfaces of pads 15 are made from a material having an increased coefficient of friction, such as a soft thermoplastic elastomer.

Each clamp 14 has a base member 16 which is preferably integrally formed with the body, and a lever member 18 movable relative thereto. The base member 16 includes a handle portion 20 and a jaw end 22, and the lever member 18 includes a handle portion 24 which is opposite handle portion 20, and a jaw end 26 which is positioned opposite jaw end 22. The lever member 18 is pivotally supported on the base member 16 along a pivot wall 28 extending between two supports 27, 29 on the base member 16. The pivot wall 28 is received in a pivot groove 30 on the back of lever member 18. A C-shaped spring clip 32, preferably made of metal, plastic or a composite, is dimensioned to receive a portion of the base member 16 and a portion of the lever member 18 and is positioned over those portions such that facing inner surfaces of the spring clip 32 bear against outwardly facing surfaces 34, 36 of the base member 16 and the lever member 18, respectively. A front end of the spring clip 32 has a flange 38 that engages within an aperture 40 in the lever member 18 to secure the spring clip 32 to the lever member. A rear end of the spring clip 32 has a tab 46 which engages a strut 48 spanning an aperture 50 in the base member 16 to secure the spring clip to the base member. The spring clip 32 urges the lever member jaw end 26 towards the base member jaw end 22.

Turning now to FIGS. 2 through 5, according to the invention, the opposing jaw ends 22, 26 are provided with respective walls (or ridges) 62, 66 which project from both sides of the corresponding jaw. On the inwardly-extending faces of the jaws (as seen best in FIG. 3*a*), the walls 62, 66 include an end wall 62*a*, 66*a*, peripheral walls 62*b*, 66*b*, 62*c*, 66*c* with slots 63, 67 extending therethrough, and a top wall 62*d*, 66*d*. The walls 62, 66 surround the gripping pads 15 which are similarly shaped. On the outwardly-extending faces of the jaws (as seen best in FIGS. 4 and 5), the walls 62, 66 include the end walls 62*a*, 66*a*, the peripheral walls 62*b*, 66*b*, 62*c*, 66*c* with slots 63, 67 extending therethrough, and well walls 62*e*, 62*f*, 66*e*, 66*f*.

Figure 6:
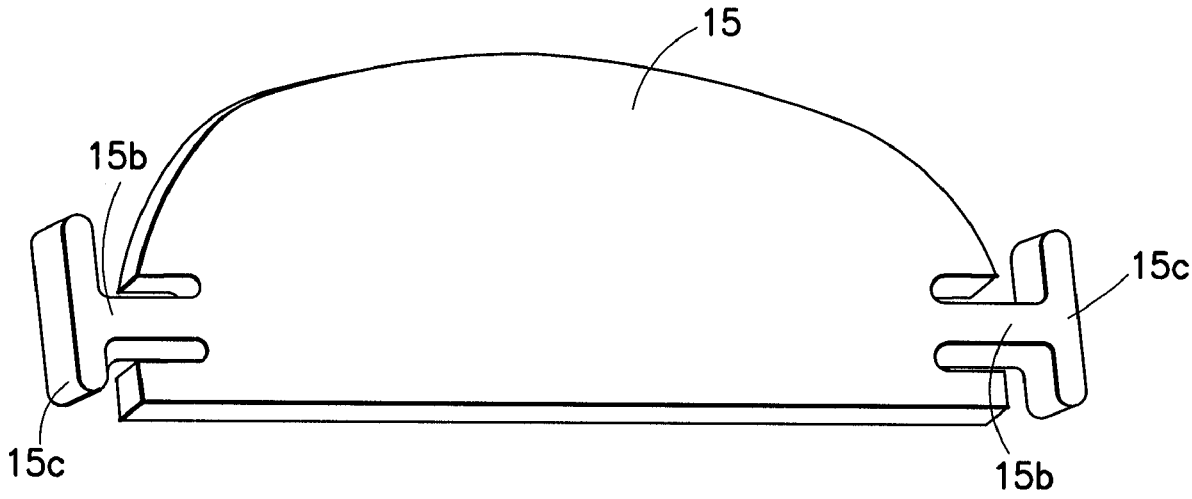
FIG. 6 is a perspective view of a pad used on the jaws of the hanger of FIG. 1.

As seen in FIG. 6, the gripping pad 15 is shaped to fit closely within the walls 62, 66 of the jaws, and further includes T-shaped lateral extensions 15*a* with necks 15*b* and heads 15*c*. The T-shaped lateral extensions are preferably realized from a thermoplastic elastomer such as TPE, TPR, TPU, or any rubber or rubber-type material. The gripping surface of the pad 15 (and possibly the entire gripping pad 15) is preferably made from the same thermoplastic elastomer as the lateral extensions, but can be formed from a different material. The material of the gripping surface preferably has as an increased coefficient of friction to provide for enhanced gripping characteristics.

With reference now to FIGS. 3*a*, 3*b*, and 4–6, the necks 15*b* are adapted, particularly when stretched, to fit through the slots 63, 67, while the heads 15*c* are adapted to be captured within the well walls 62*e*, 62*f*, 66*e*, 66*f*. Thus, the heads 15*c* are sized to be just slightly smaller than the size of the wells, with the well walls acting to prevent removal of the gripping pad from the jaw via a finger purchase. In particular, the height of each head 15*c* is preferably smaller than the height of the well walls (see FIG. 3*b*), and the length of the head is sized to fit within the well walls (see FIG. 4). With the necks 15*b* of pads 15 extending through the slots in the peripheral walls of the jaw ends, and the heads 15*c* captured within the well walls, the pads are prevented from falling off the jaw member.

Figure 7:
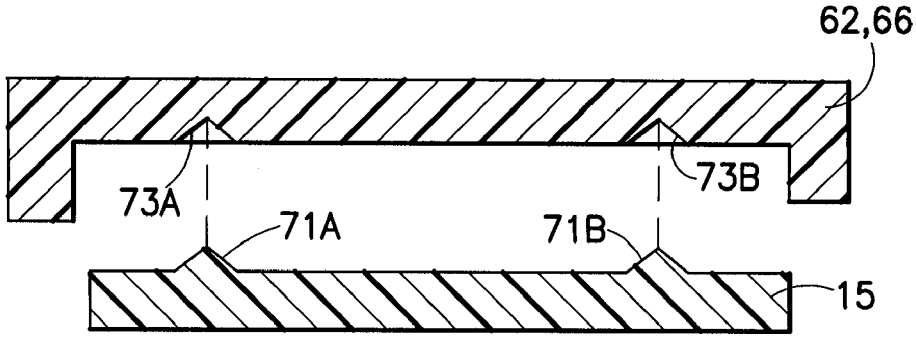
FIG. 7 is a cross-sectional exploded view of an exemplary gripping pad and jaw member in accordance with the present invention.

In addition, it is preferable that the offset between the height of the walls 62, 66 and the height of the gripping pad surfaces supported therein be minimized. This feature makes its difficult to grab onto the gripping pad and remove it by finger manipulation. If desired, the back surfaces of the pads can also be glued to the inwardly facing surfaces of the jaw ends to assist in holding the gripping pad in place. The back surfaces of the gripping pads can also have one or more bottom ridges which fit into corresponding slots in the inwardly facing surfaces of the jaw ends to provide for accurate placement and alignment of the pad. FIG. 7 shows an exemplary design with bottom ridges 71A, 71B and the corresponding slots 73A, 73B having a wedge shape. The ridges and slots can extend in a direction parallel to the horizontal cross bar of the hanger body, transverse to the horizontal cross bar of the hanger body, in a cross-hatched pattern, or in some other configuration.

The gripping surface of the gripping pads 15 may also include a textured or patterned structure that provides for increased coefficient of friction and enhanced gripping characteristics. FIG. 8A shows an exemplary design with a texture pattern of nubs that project from the gripping pad. FIG. 8B shows another exemplary design with a pattern of cross-hatched grooves. Preferably, the height of the gripping surface of the gripping pad 15 is adapted such that the offset between the height of the walls 62, 66 and the height of the gripping surface is minimized. This feature makes its difficult to grab onto the gripping pad and remove it by finger manipulation.

With the jaw pads 15 and jaw clamps 14 as provided, according to the invention the hanger is assembled by placing the pads 15 on the inward faces of the jaw clamps 14, and for each clamp, coupling the pad to the clamp by gripping the pads by the heads 15*c*, preferably stretching the necks 15*b* by pulling the heads laterally, placing the necks 15*b* of the pad through the slots 63, 67 in the peripheral walls 62*b*, 62*c*, 66*b*, 66*c* and releasing heads 15*c* within the well walls 62*e*, 62*f*, 66*e*, 66*f* such that the well walls substantially surround the heads 15*c* and prevent a finger purchase thereon. Preferably, the pad 15 is coupled to the jaw clamp of the lever member 18 prior to the assembly of the lever member 18 on the base member 16 and prior to the positioning of the spring clip 32 on the lever member 18 and base member 16.

An alternate embodiment of the present invention is shown in FIG. 9 in which the wells 62*e*, 62*f*, 66*e*, 66*f* realized on the outwardly-extending faces of the jaws are sized such that they are larger than the heads 15*c* of the extensions. A cover 901 extends over each respective well to cover a portion of the well that is disposed adjacent the slot 63. The other portion 903 of the well remains open. During assembly, the neck 15*b* is stretched such that the head 15*c* is placed into the open well portion 903. Upon release of the head, the neck 15*b* resiliently contracts such that the head 15*c* rests in place under the cover 901. In this manner, the cover 901 covers and hides the head 15*c*, thereby making its difficult to grab onto the gripping pad 15 and remove it by finger manipulation.

There has been described and illustrated herein an embodiment of a hanger having non-slip pads, and a method of assembling that hanger. While a particular embodiment of the invention have been described, it is not intended that the invention be limited thereto, as it is intended that the invention be as broad in scope as the art will allow and that the specification be read likewise. Thus, while particular materials have been disclosed for the pads, it will be appreciated that other materials could be used as well. In addition, while a particular pinch-type hanger has been described, it will be understood that the pad can be used on different types of gripping hangers. For example, the pads can be used on a "clip-style" clamp hanger wherein the two opposing jaw members are coupled by a hinged interface provided at or near the top edge of the two jaw members. A c-shaped clip slides over the top of the two jaw members. In a closed-position, the clip biases the jaw members towards each other to create the clamping force necessary to retain a garment between inner surfaces of the jaw members. In order to remove a garment held between the two jaw members, the clip is pulled upward such that the two jaw members are free to open relative to one another (about the hinged interface). In this position, the garment can be easily removed from the jaw members. It will therefore be appreciated by those skilled in the art that yet other modifications could be made to the provided invention without deviating from its spirit and scope as claimed.

What is claimed is:

1. A hanger, comprising:

a) a body;

b) at least one clamp coupled to said body, said clamp including a pair of opposed clamping members that are urged towards each other, at least one of said clamping members having peripheral walls and having slots extending through said peripheral walls of said at least one clamping member, and having a back surface including wall areas adjacent said slots defining wells; and c) at least one gripping pad having T-shaped lateral extensions with necks and heads, wherein said necks of said T-shaped lateral extensions extend through said slots of said peripheral walls, said heads of said T-shaped lateral extensions are held in said wells thereby preventing said gripping pad from falling off said clamping member;

wherein said wells and said heads are shaped and sized to prevent removal of said gripping pad from said clamping member via a finger purchase of said heads.

2. A hanger according to claim 1, wherein:

said wells substantially surround all sides of said heads.

3. A hanger according to claim 1, wherein:

said wells have a top cover that is adapted to cover and hide said heads of said gripping pad.

4. A hanger according to claim 1, wherein:

said lateral extensions are realized from an elastomeric thermoplastic.

5. A hanger according to claim 4, wherein:

said gripping pads are realized from an elastomeric thermoplastic.

6. A hanger according to claim 5, wherein:

said elastomeric thermoplastic comprises TPE, TPR, TPU, a rubber or rubber-type material, or any combination thereof.

7. A hanger according to claim 1, wherein:

both of said pair of clamping members have peripheral walls and slots extending through said peripheral walls of said clamping members, and having a back surface including wall areas adjacent said slots defining wells, and said at least one elastic gripping member comprises two gripping members, one for each of said pair of clamping members.

8. A hanger according to claim 7, wherein:

said at least one clamp comprises two clamps, with each of said two clamps having a said pair of clamping members, and each clamping member having a respective gripping member coupled thereto.

9. A hanger according to claim 1, wherein:

said gripping pad includes a textured surface.

10. A hanger according to claim 9, wherein:

said textured surface includes a plurality of surface nubs.

11. A hanger according to claim 1, wherein:

said gripping surface includes a patterned surface.

12. A hanger according to claim 11, wherein:

said patterned surface includes a plurality of grooves.

13. A hanger according to claim 1, wherein:

said body comprises one of plastic and resin.

14. A hanger according to claim 13, wherein:

at least one of said pair of clamping members is integral with said body, and said gripping pad is softer than said body.

15. A hanger according to claim 1, wherein:

said at least one of said clamping members has an end wall adjacent said peripheral walls and a top wall adjacent said peripheral walls.

16. A hanger according to claim 15, wherein:

said end wall, said peripheral walls and said top wall define an inwardly facing surface having a shape, and said gripping pad has a shape substantially the same as said shape of said inwardly facing surface.

17. A hanger according to claim 1, further comprising:

biasing means coupled to each of said pair of clamping members for biasing said pair of opposing clamping members towards one another.

18. A hanger according to claim 1, further comprising:

a hook extending from said body.

19. A method of assembling the hanger of claim 1, comprising:

for each clamping member, placing a said gripping pad on a front surface of a said clamping member, and coupling the said gripping pad to said clamping member by placing said necks of said gripping pad through said slots in said peripheral walls and releasing said heads within said wells such that said well walls substantially surround said heads.

20. The method of claim 19, wherein:

said coupling comprises holding said gripping pad by said heads while placing said necks through said slots.

21. The method of claim 20, wherein;

said coupling further comprises stretching said necks while placing said necks through said slots.

22. The method of claim 21, wherein:

said stretching said necks comprises pulling laterally on said heads.

23. The method of claim 19, further comprising:

after said coupling, assembling said clamping members.

24. The method of claim 23, further comprising:

providing biasing means that are adapted to bias said pair of opposing clamping members towards one another;

placing said clamping members in contact with each other; and placing said biasing means in contact with each of said clamping members.

* * * * *